United States Patent [19]

Oguro

[11] 4,282,459

[45] Aug. 4, 1981

[54] MAGNETRON

[76] Inventor: Tomokatsu Oguro, 923-13, Nakanoshima, Mobara City, Chiba Prefecture, Japan

[21] Appl. No.: 72,006

[22] Filed: Sep. 4, 1979

[30] Foreign Application Priority Data

Sep. 6, 1978 [JP] Japan ..... 53-108656

[51] Int. Cl.[3] ..... H01J 25/50

[52] U.S. Cl. ..... 315/39.71; 315/39.51; 315/39.75

[58] Field of Search ..... 315/39.71, 39.51, 39.53, 315/39.75

[56] References Cited

U.S. PATENT DOCUMENTS

| | | | |
|---|---|---|---|
| 3,588,588 | 6/1971 | Numata | 315/39.53 |
| 3,794,879 | 2/1974 | Edwards | 315/39.71 |
| 3,881,127 | 4/1975 | MacMaster et al. | 315/39.71 |
| 4,048,542 | 9/1977 | Miura | 315/39.71 |
| 4,063,129 | 12/1977 | Miura et al. | 315/39.71 |
| 4,071,804 | 1/1978 | Koinuma et al. | 315/39.71 |

*Primary Examiner*—Saxfield Chatmon, Jr.
*Attorney, Agent, or Firm*—Charles E. Pfund

[57] ABSTRACT

In an inner magnet type magnetron wherein a pair of permanent magnets axially magnetized are opposed to each other with an interaction space therebetween within a vacuum enclosure comprising a cylindrical anode, a repulsive magnet magnetized in a direction substantially perpendicular to the magnetization direction of the permanent magnet is arranged in the proximity of one end of the permanent magnet close to the interaction space, thereby preventing leakage flux from the permanent magnet to the inner wall of the cylindrical anode.

5 Claims, 3 Drawing Figures

MAGNETRON

BACKGROUND OF THE INVENTION

The present invention concerns magnetrons, and more particularly it concerns a magnetic circuit structure for so-called inner magnet type magnetron wherein permanent magnets are built in a vacuum enclosure.

Generally, the magnetron is used for defrosting and heating foodstuffs as it is incorporated in electronic ovens and efficiently generates microwaves, Magnetrons of the type wherein magnets are provided outside a vacuum enclosure have conventionally been used widely, but there has also been proposed in the art so-called inner magnet type magnetron wherein the magnets are built inside the vacuum enclosure in order to miniaturize the magnetron and decrease the material cost.

In the inner magnet type magnetron, a cylindrical anode and end plates provided on opposite ends thereof constitute a vacuum enclosure, and a pair of permanent magnets respectively attached to one end plate and the other end plate are opposed to each other with an interaction space therebetween. A magnetic circuit is established, comprising the one permanent magnet, one end plate, cylindrical anode, the other end plate, the other permanent magnet and the interaction space, for applying magnetic flux to the interaction space. However, in the inner magnet type magnetron for which miniaturization is intended, the space between the permanent magnets and the cylindrical anode is extremely narrow so that the magnetic flux between the two becomes short-circuited and a great deal of flux leaks from the pair of the permanent magnets. Although such expensive permanent magnetic material as Alnico is used, the utility efficiency of the magnetic flux in the interaction space is therefore quite low.

SUMMARY OF THE INVENTION

An object of the present invention, therefore, is to obviate the above mentioned defects, and to provide a magnetron wherein leakage flux of the permanent magnets is minimized, and a uniform and efficient flux density distribution is obtained in the interaction space.

In order to achieve the above object, according to the invention, in an inner magnet type magnetron wherein a pair of axially magnetized permanent magnets are opposed to each other with an interaction space therebetween, a repulsive magnet which is magnetized in a direction substantially perpendicular to the magnetron axis is arranged on the outer periphery of at least one of the pair of permanent magnets at one end of the permanent magnet close to the interaction space.

DESCRIPTION OF THE PREFERRED EMBODIMENT

Before going into the details of a preferred embodiment of the magnetron in accordance with the present invention, the problem of leakage flux from the permanent magnets is explained referring to a conventional inner magnet type magnetron by way of an illustration.

Figure 1:
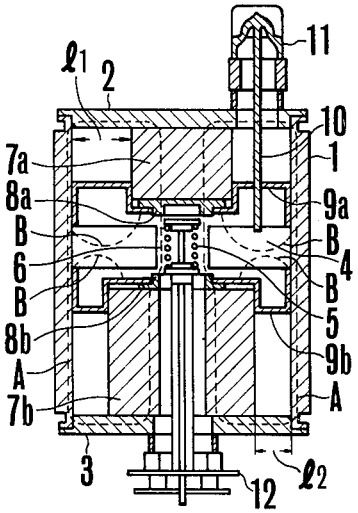
FIG.1 (PRIOR ART)
FIG. 1 shows a sectional view showing an example of a conventional inner magnet type magnetron.

Referring to FIG. 1, the conventional type magnetron shown has a vacuum enclosure comprising a cylindrical anode 1, an upper plate 2 and a lower plate 3 which are respectively provided on the upper and lower ends of the anode 1. Inside the vacuum enclosure are provided a plurality of vanes 4 extending toward the center axis from the inner wall of the anode 1, a cathode 5 positioned concentrically and interiorly of the anode 1, a pair of permanent magnets 7*a* and 7*b* supplying efficiently and uniformly magnetic flux to an interaction space 6 defined by the tips of the vanes 4 and the cathode, pole pieces 8*a* and 8*b*, magnet supports 9*a* and 9*b* to hold the permanent magnets 7*a*, 7*b* and pole pieces 8*a*, 8*b* in a place and an antenna 10 connected to a specific vane 4 to transmit the microwave output exteriorly of the vacuum enclosure. To the upper plate 2 which constitutes a portion of the enclosure is connected an output dome 11, whereas to the lower plate 3 is connected a stem 12.

The magnetic support 9*a* supports the magnet 7*a* and pole piece 8*a* which are inserted into a central cylindrical portion. The magnet support 9*b* also supports in a similar manner the permanent magnet 7*b* and the pole piece 8*b*. These magnet supports 9*a* and 9*b* are made of a non-magnetic material so as to prevent short-circuiting of the magnetic circuit and leakage flux.

In the inner magnet type magnetron as constructed above, the magnetic flux emitting from the permanent magnets 7*a*, 7*b* flows through a closed loop of magnetic circuit in a route as indicated by the dotted lines A in the figure, and achieves a uniform magnetic density distribution in the interaction space 6.

However, in the inner manget type magnetron of the above construction, spaces $l_1$, $l_2$ between the permanent magnets 7*a*, 7*b* and the inner wall of the cylindrical anode 1 are extremely small, and there are formed magnetic circuits between the permanent magnets and the inner wall of the cylindrical anode, causing the magnetic flux B to short-circuit, and a great deal of flux from the permanent magnets 7*a*, 7*b* fails to reach the interaction space but become leakage flux. In other words, only a few percents of the flux from the permanent magnets 7*a*, 7*b* is utilized in the interaction space, and a sufficiently efficient use cannot be attained even with the permanent magnets 7*a* and 7*b* made from such an expensive material as Alnico or Sm-Co.

Figure 2:
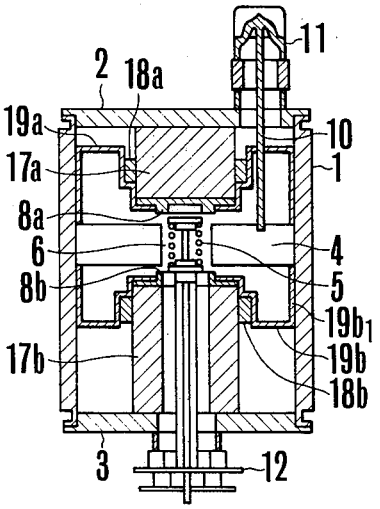
FIG. 2 is a sectional view showing one embodiment of an inner magnet type magnetron in accordance with the present invention.

FIG. 2 shows an embodiment of the magnetron in accordance with the present invention, where the same reference numerals in FIG. 1 denote the same elements and the further explanations thereof are omitted. In FIG. 2, on the outer peripheries of axially magnetized permanent magnets 17*a*, 17*b* and at ends of these magnets close to an interaction space 6 are provided securely doughnut shaped repulsive magnets 18*a*, 18*b* which are magnetized in a direction substantially perpendicular to the magnetization of the permanent magnets 17*a*, 17*b*, that is, magnetized radially of the magnetron, the repulsive magnets being fitted into the magnet support 19*a* and 19*b*, respectively. In this case, the repulsive magnets are magnetized in such a way that they will have the same polarity as that at the end of the permanent magnet close to the interaction space along the inner periphery of the repulsive magnet, and the opposite polarity to that at the end along the outer periphery. The repulsive magnets are made of a material of a larger coercive force and more preferably of a material having a greater coercive force than the permanent magnet (such as for example Alnico 8 combined with the permanent magnet of Alnico 5) because when the permanent magnets 17*a* and 17*b* are subjected to an adjustment for demagnetization by being applied with an axial, external magnetic field, the repulsive magnets 18*a* and 18*b* are not so demagnetized as the permanent magnets and still remain effective to keep their function.

Figure 3:
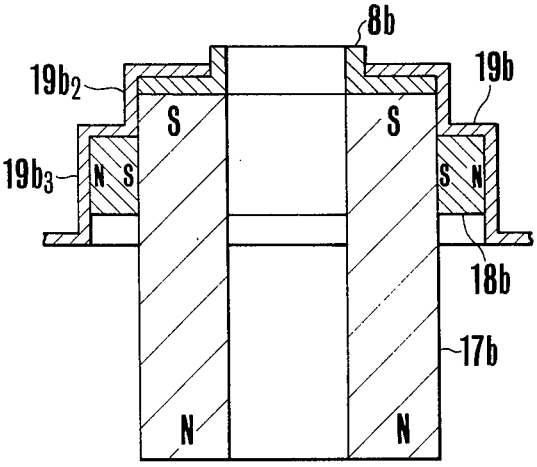
FIG. 3 is a partially enlarged sectional view showing a mounting structure for a repulsive magnet in the magnetron shown in FIG. 2.

FIG. 3 shows an exaggerated view of a mounting structure for the repulsive magnet 18*b* associated with the lower permanent magnet 17*b*. An upper mounting structure is similar and not detailed herein. As shown in FIG. 3, when one end of the permanent magnet 17*b* close to the interaction space is made S pole, then the repulsive magnet 18*b* is so magnetized as to make its inner periphery S pole, thereby opposedly placing S poles of the permanent magnet 17*b* and the repulsive magnet 18*b* in close proximity to each other. A cup shaped magnet support 19*b* having a side wall $\mathbf{19}b_1$ (FIG. 2) which is fitted into the inner wall of the cylindrical anode 1 has a portion of the bottom wall which extends in the direction of the axis of the magnetron, the bottom wall portion having a smaller diameter portion $\mathbf{19}b_2$ having a diameter substantially the same as the outer diameter of the pole piece 8*b* and the permanent magnet 17*b* and a large diameter portion $\mathbf{19}b_3$ having a diameter which is substantially the same as the outer diameter of the repulsive magnet 18*b*. At the center of the magnet support 19*b* is formed an opening, and the pole piece 8*b* partially extending through the opening and one end of the permanent magnet 17*b* are fitted in the small diameter portion $\mathbf{19}b_2$, whereas the repulsive magnet 18*b* encircling the permanent magnet 17*b* is fitted in the large diameter portion $\mathbf{19}b_3$. S pole of the permanent magnet 17*b* and S pole of the repulsive magnet 18*b* generate a magnetic repulsive force in the radial direction. This repulsive force is used acting to bias the side wall $\mathbf{19}b_1$ of the cup shaped magnet support 19*b* against the inner wall of the cylindrical anode.

In the magnetron as constructed above, S pole magnetism leaking toward the inner wall of the cylindrical anode 1 from the end of the permanent magnet 17*b* close to the interaction space is completely repelled by the S pole magnetism of the repulsive magnet 18*b* so that the leakage flux toward the inner wall of the cylindrical anode 1 becomes minimized, thereby obtaining a uniform and efficient high density flux distribution in the interaction space 6. Accordingly, it is possible to obtain the predetermined flux density distribution of the conventional art in the interaction space 6 even with the miniaturized permanent magnet 17*b*. The repulsive magnet 18*b* itself may be small since it merely encircles the outer periphery of the permanent magnet 17*b* miniaturized in diameter, and the sum of volumes of the permanent magnet 17*b* and the repulsive magnet 18*b* may be further minimized than the conventional type permanent magnet 7*b*, thus reducing the required quantity of the magnetic material.

According to this invention, not only leakage from the permanent magnet 17*b* to the cylindrical anode 1 but also the leakage flux along the longitudinal surface of the permanent magnet 17*b* may be reduced. As the volume of the magnet is thus minimized, the strength of the magnet support 19*b* to support and fix the magnet may also be lowered, facilitating the use of thin and inexpensive material for the support.

In the above explanation, effects of the repulsive magnet 18*b* associated with the lower permanent magnet 17*b* (on the input side) was discussed. It is axiomatic that the repulsive magnet 18*a* associated with the upper permanent magnet 17*a* (on the output side) also presents identical effects. As the need arises, the repulsive magnets are combined with the upper and the lower permanent magnets, or the repulsive magnet may be combined only with one permanent magnet.

In the above embodiment, explanation was given of a repulsive magnet shaped like a doughnut. However, the present invention is not to be limited to this embodiment alone. The repulsive magnet may be comprised of three segments sectioned by 120 degrees. The explanation was given by way of an example where the permanent magnets and the repulsive magnet were arranged in a vacuum, but the present invention is not to be limited to this embodiment alone. For instance, the permanent magnets may be positioned in vacuum, an airtight non-magnetic metallic cover may be provided on the outer periphery of the permanent magnet, and the repulsive magnets may be arranged outside the non-magnetic metallic cover. The explanation of the permanent magnets was made in respect of the simple, straight cylinder, but the present invention is not to be limited to this shape. The same effects are obtained with such shapes like tapered cylinder, stepped cylinder and the like.

As explained in the foregoing, the magnetron in accordance with the present invention facilitates a radical decrease of leakage flux from the permanent magnets by positioning the magnet for repulsing flux at the point where the leakage occurs, and also achieves a uniform and efficient high density flux distribution in the interaction space. Accordingly, the invention achieves a truly remarkable effect of reducing the amount of magnetic material required and offering compact and inexpensive magnetrons.

What is claimed is:

1. A magnetron comprising a cylindrical anode having a plurality of vanes arranged radially to surround a cathode, an interaction space defined by a space between the tip of said vanes and said cathode, a pair of permanent magnets being opposed to each other with the interaction space therebetween and magnetized axially, and a repulsive magnet arranged around the outer periphery of at least one of said pair of permanent magnets and at one end of the permanent magnet close to the interaction space, said repulsive magnet being magnetized in a direction substantially perpendicular to the magnetization direction of said permanent magnet with the polarity made identical with that of said permanent magnet in the proximity thereof.

2. A magnetron as claimed in claim 1 wherein said repulsive magnet comprises a doughnut shaped repulsive magnet magnetized in radial direction and said one permanent magnet comprises a cylindrical permanent magnet arranged on the input side of said magnetron.

3. A magnetron as claimed in claim 1 wherein said repulsive magnet is made of a material with a larger coercive force than that of said permanent magnet.

4. A magnetron as claimed in claim 1 wherein said permanent magnets and repulsive magnet are placed within a vacuum enclosure of the magnetron, said permanent magnet being fitted in a small diameter portion forming a part of the bottom wall of a cup shaped magnet support means, said repulsive magnet encircling the permanent magnet being fitted in a large diameter portion forming a part of the bottom wall of said magnet support means, the side wall of said cup shaped magnet support means being secured to the inner wall of said cylindrical anode.

5. A magnetron as claimed in claim 1 wherein said permanent magnets are provided in a vacuum enclosure of the magnetron and the repulsive magnet is provided exteriorly of the vacuum enclosure.

* * * * *

UNITED STATES PATENT AND TRADEMARK OFFICE

CERTIFICATE OF CORRECTION

PATENT NO. : 4,282,459

DATED : August 4, 1981

INVENTOR(S) : Tomokatsu Oguro

It is certified that error appears in the above—identified patent and that said Letters Patent is hereby corrected as shown below:

On the Title page, item [73], insert Assignee: Hitachi, Ltd., Tikyo, Japan --.

Signed and Sealed this

Fifteenth Day of June, 1993

Michael K. Kirk

*Attest:*

MICHAEL K. KIRK

*Attesting Officer*

*Acting Commissioner of Patents and Trademarks*